US008915392B2

(12) United States Patent
Crispin et al.

(10) Patent No.: US 8,915,392 B2
(45) Date of Patent: Dec. 23, 2014

(54) HINGED LID FOR BATTERY COMPARTMENT IN A MANUALLY ROTATABLE ADJUSTMENT KNOB

(71) Applicants: Quint Crispin, Beaverton, OR (US); Xuyen Huynh, Hillsboro, OR (US)

(72) Inventors: Quint Crispin, Beaverton, OR (US); Xuyen Huynh, Hillsboro, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 21 days.

(21) Appl. No.: 13/738,771

(22) Filed: Jan. 10, 2013

(65) Prior Publication Data

US 2013/0174490 A1 Jul. 11, 2013

Related U.S. Application Data

(60) Provisional application No. 61/585,230, filed on Jan. 10, 2012.

(51) Int. Cl.

| | |
|---|---|
| ***B65D 43/16*** | (2006.01) |
| ***F41G 1/38*** | (2006.01) |
| ***E05C 19/00*** | (2006.01) |
| ***E06B 3/34*** | (2006.01) |

(52) U.S. Cl.

CPC . *E05C 19/00* (2013.01); *E06B 3/34* (2013.01); *F41G 1/38* (2013.01)

USPC ..... 220/254.3; 42/111; 42/122; 220/835; 220/849

(58) Field of Classification Search

CPC ..... F41G 1/345; F41G 1/38; E05C 19/00; E06B 3/34; B65D 43/16; B65D 43/164; B65D 43/165; B65D 43/22; B65D 2251/10

USPC ..... 220/254.3, 833–835, 849; 215/235, 215/237, 244, 245; 42/111, 122

See application file for complete search history.

(56) References Cited

U.S. PATENT DOCUMENTS

| | | | |
|---|---|---|---|
| 1,912,187 | A | 5/1933 | Fullmer |
| 2,033,295 | A | 3/1936 | Parkin |

(Continued)

FOREIGN PATENT DOCUMENTS

| | | | |
|---|---|---|---|
| CH | 667766 | A | 10/1988 |

OTHER PUBLICATIONS

Premier Reticles, "Premier Heritage™ 3-15X50 User Manual," available as early as Oct. 18, 2008.

(Continued)

*Primary Examiner* — Fenn Mathew
*Assistant Examiner* — James N Smalley
(74) *Attorney, Agent, or Firm* — Stoel Rives LLP; Robert R. Teel

(57) ABSTRACT

A rotatable adjustment knob has a knob body mountable to an optical or electronic device for rotation about an axis extending outwardly from the device. The knob body has an opening into a battery compartment sized to receive a battery. A lid is pivotably attached to the knob body for movement between a closed position in which the lid covers the opening, and an open position in which the lid is pivoted away from the opening to provide access to the battery compartment. The lid remains attached to the knob body while in both the open and closed positions for rotation with the knob body about the axis. A resilient seal confronts the knob body and the lid while the lid is in the closed position to thereby seal the opening and the battery compartment. A latch releasably retains the lid in the closed position.

19 Claims, 8 Drawing Sheets

(56) References Cited

U.S. PATENT DOCUMENTS

| | | | | |
|---|---|---|---|---|
| 2,450,949 | A * | 10/1948 | Gattuccio et al. | 116/308 |
| 2,671,819 | A | 3/1954 | Field | |
| 3,999,110 | A | 12/1976 | Karasa et al. | |
| 4,160,857 | A | 7/1979 | Feeney et al. | |
| 4,230,777 | A * | 10/1980 | Gatto | 429/97 |
| 4,800,238 | A | 1/1989 | Gesvent | |
| 4,965,141 | A | 10/1990 | Suzuki | |
| 5,008,943 | A | 4/1991 | Arndt et al. | |
| 5,032,857 | A | 7/1991 | Fujii et al. | |
| 5,206,098 | A | 4/1993 | Cho et al. | |
| 5,270,702 | A | 12/1993 | Krolak | |
| 5,670,268 | A | 9/1997 | Mancusi | |
| 5,820,406 | A | 10/1998 | Hetherington | |
| 5,950,368 | A | 9/1999 | Bradford | |
| 6,409,042 | B1 | 6/2002 | Hirano et al. | |
| 6,512,348 | B1 | 1/2003 | Wellisz et al. | |
| 6,702,137 | B1 * | 3/2004 | Kowa et al. | 220/254.5 |
| 6,721,095 | B2 | 4/2004 | Huber | |
| 6,749,363 | B1 | 6/2004 | Petersen | |
| 7,510,796 | B2 | 3/2009 | Tokano et al. | |
| 7,726,902 | B1 | 6/2010 | Bongiovanni et al. | |
| 7,916,885 | B2 | 3/2011 | Nielson | |
| 2004/0124200 | A1 | 7/2004 | Yuhara | |
| 2005/0161463 | A1 | 7/2005 | Litchman | |
| 2005/0182457 | A1 * | 8/2005 | Thrope et al. | 607/48 |
| 2005/0277453 | A1 | 12/2005 | Kim | |
| 2007/0118189 | A1 * | 5/2007 | Nakamura | 607/96 |
| 2009/0159607 | A1 | 6/2009 | Kratzer | |
| 2011/0167708 | A1 | 7/2011 | Cheng | |
| 2012/0154907 | A1 | 6/2012 | Schmit et al. | |
| 2012/0186131 | A1 * | 7/2012 | Windauer | 42/122 |

OTHER PUBLICATIONS

Hawke® Sport Optics, "Sidewinder® 30, A Revolution in Design, Reference Guide," available as early as May 6, 2009.

* cited by examiner

HINGED LID FOR BATTERY COMPARTMENT IN A MANUALLY ROTATABLE ADJUSTMENT KNOB

RELATED APPLICATIONS

This application claims priority benefit under 35 U.S.C. §119(e) of U.S. Provisional Patent Application No. 61/585,230, filed Jan. 10, 2012, which is incorporated herein by reference in its entirety.

TECHNICAL FIELD

The field of the present disclosure relates generally to rotatable adjustment mechanisms having internal battery compartments and, more particularly, to rotatable adjustment knobs for controlling electrical elements such as a brightness setting for a battery-powered illuminated reticle in a sighting device, such as a riflescope, telescope, or other aimed optical device.

BACKGROUND INFORMATION

Sighting devices have long been used in conjunction with weapons and firearms, such as rifles, handguns, and crossbows, to allow a shooter to accurately aim and shoot at a selected target. The accuracy of a shot can be affected by variations in shooting conditions such as bullet and arrow trajectory, wind conditions, distance to the target, and lighting conditions. To compensate for these variations and improve the accuracy of a shot, some sighting devices provide controls to allow a shooter to make incremental adjustments to the optical characteristics or location of aiming marks of the sighting device.

Typically, such adjustments are made using rotatable adjustment knobs that actuate an adjustable member of the sighting device. Knobs that adjust the relative alignment between an optical path and a crosshair (or a reticle) are known as "elevation" and "windage" controls, for adjusting respective vertical and horizontal aim. Rotatable knobs may also be used to adjust other features of riflescopes, binoculars, spotting scopes, or other suitable optical devices, such as parallax, focus, reticle illumination intensity, reticle type, or other suitable features.

Some sighting devices or other devices include adjustment knobs with internal battery compartments for retaining a battery that powers electronics or lighting associated with the device or a weapon on which the device is mounted. For example, rotatable knobs with internal battery compartments may be used in various configurations for activating or adjusting the brightness of an illuminated reticle. In some riflescopes, for example, an on/off/brightness adjustment knob is positioned on a main tube of a sight housing. Other riflescopes have an on/off switch activated by pulling a parallax adjustment knob. Typically, for these knobs, a battery cap is provided that screws onto the end of the knob for closing and sealing the battery compartment from water and moisture. Rotation of a screw-on cap, however, may also inadvertently twist the knob and change the adjustment setting.

Conventional screw-on battery caps are often cumbersome to twist on and off because the fine screw threads used are sometimes difficult for a user to properly align. Also, a small bladed tool or screwdriver is usually needed for loosening and unscrewing the battery cap from the adjustment knob. Moreover, once removed, screw-on battery caps can easily be dropped or misplaced.

It is known to add a retention strap or cord to tether a screw-on battery cap to the housing of the adjustment knob or the main tube. However, these retention straps are prone to snagging and catching on other objects, or the retention straps may fray or break. Furthermore, retention straps will occasionally bind the screw-on battery covers or otherwise make the cover more cumbersome to twist on and off from the adjustment knob. Retention straps also hinder rotational adjustment of the knob, making it more difficult to activate, adjust, or precisely control associated electronics settings.

SUMMARY

According to one embodiment, a rotatable adjustment knob for an optical or electronic device includes a knob body mountable to the device for rotation about an axis extending outwardly from the device. The knob body includes an opening into a battery compartment sized to receive a battery. The knob includes a lid pivotably (or hingedly) attached to the knob body for movement between a closed position in which the lid covers the opening, and an open position in which the lid is pivoted away from the knob body and the opening to facilitate access of the battery compartment. The lid remains attached to the knob body while in both the open and closed positions for rotation with the knob body about the axis. The knob includes a resilient seal bordering the opening and confronting the knob body and the lid while the lid is in the closed position. The knob includes a latch to releasably retain the lid in the closed position.

Additional aspects and advantages will be apparent from the following detailed description of embodiments, which proceeds with reference to the accompanying drawings.

DETAILED DESCRIPTION OF EMBODIMENTS

Figure 1:
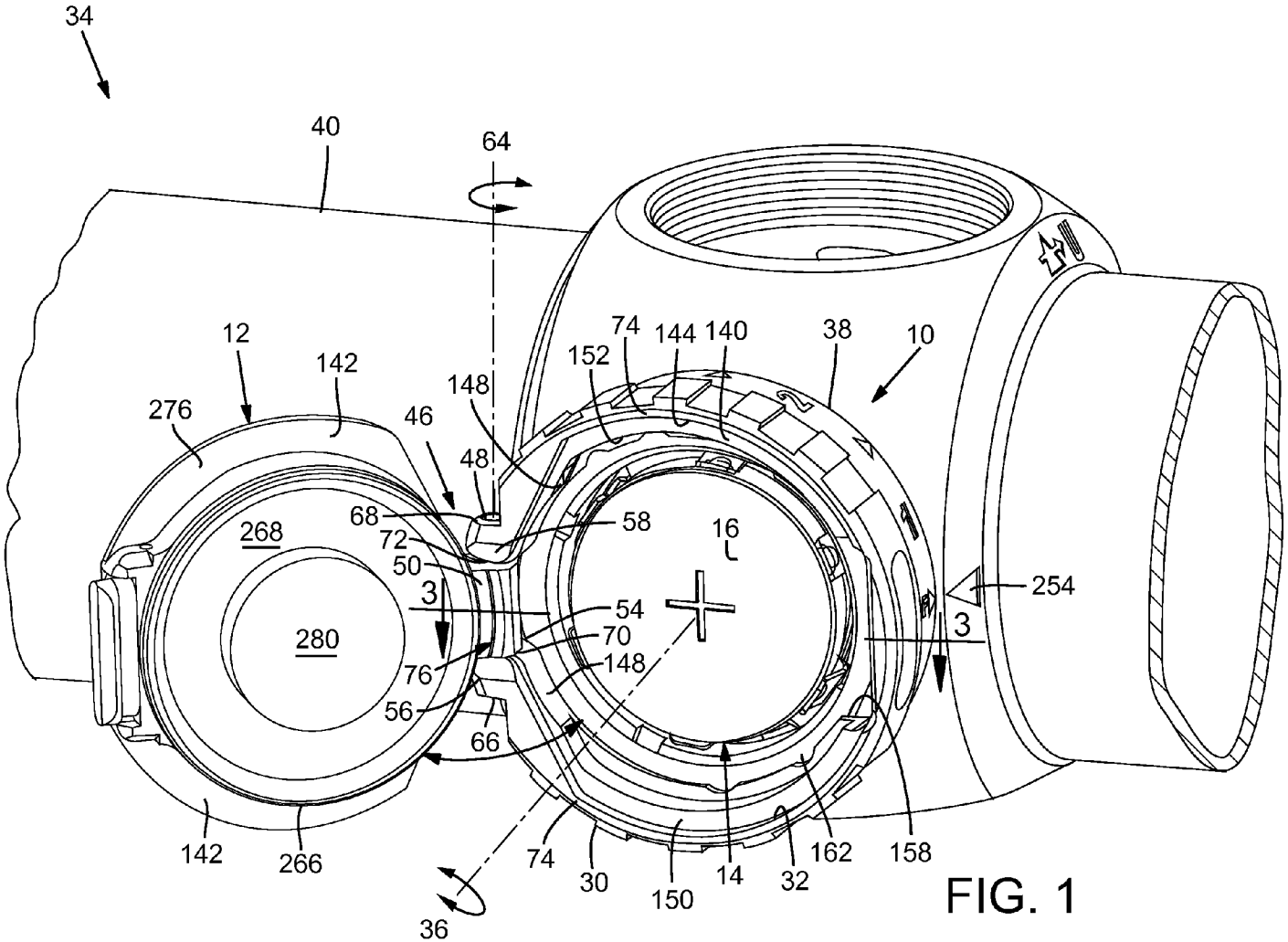
FIGS. 1 and 2 are isometric views of a rotatable adjustment knob, according to a first embodiment, including a hinged lid shown in respective open and closed positions.

FIGS. 1-6 show a rotatable adjustment knob 10 (or simply, knob 10) having a lid 12 for accessing and enclosing an internal battery compartment 14 that retains a battery 16 within knob 10. Lid 12 is hingedly attached to a knob body 30 for movement of lid 12 between a closed position (FIGS. 2 and 4) in which lid 12 covers battery compartment 14, and an open position (FIGS. 1 and 3) in which lid 12 is pivoted away from knob body 30 to reveal an opening 32 through which battery 16 may be inserted into and removed from battery compartment 14.

To adjust a setting of a riflescope 34, lid 12 and knob body 30 are rotated about an axis of rotation 36 that extends outwardly from a seat 38 that is located on a housing main tube 40 of riflescope 34. For example, in some embodiments, knob body 30 is manually rotatable about axis 36 to adjust an illumination or brightness intensity setting for an associated illuminated reticle (not shown) that is viewable through an eyepiece end (not shown) of riflescope 34. In other rotatable adjustment knob embodiments, optical, electrical, or mechanical settings may be established based on the position of the knob.

A hinge assembly 46 includes a hinge pin 48, a hinge knuckle 50 extending from lid 12, a knuckle bore 52 (FIG. 6) through hinge knuckle 50, a notch 54 in knob body 30, and two opposing hinge-pin eyelets 56 and 58 having respective eyes 60 and 62 (FIG. 6) for retaining hinge pin 48. With hinge knuckle 50 inserted into notch 54, and with hinge pin 48 inserted through eyes 60 and 62 (via eyelets 56 and 58) and through knuckle bore 52 (FIG. 6), hinge assembly 46 rotatably couples lid 12 and knob body 30, allowing lid 12 to swing between the open and closed positions about a pivotal axis 64. Thus, lid 12 remains pivotably attached to knob body 30 and can be opened or closed regardless of the rotational position of knob 10 about axis of rotation 36, and without hindering rotation of knob 10.

Lid 12 is pivotably movable relative to knob body 30 about pivotal axis 64, which extends in a direction transverse to axis of rotation 36. Thus, pivotal axis 64 is substantially perpendicular to axis 36 so that lid 12 swings open and closed, i.e., hingedly about axis 64. In other embodiments, hinge pins may be positioned in other orientations relative to a knob's axis of rotation. For example, a pivotal axis of a lid may be parallel relative to a rotational axis of a knob body such that a lid slides or swings laterally about the pivotal axis and away from an opening. Some other embodiments may include pivot joints and various other connections, including ball joints, living hinges (e.g., plastic resin living hinges), or other types of connections.

Opposing outer sidewalls 66 and 68 of respective eyelets 56 and 58 are each defined within portions of knob body 30. Likewise, confronting first and second inner sidewalls 70 and 72 define sidewalls of notch 54. Thus, eyelets 56 and 58 are integral to knob body 30 such that hinge assembly 46 sits entirely flush or beneath an outer face 74 of knob body 30.

Figure 4:
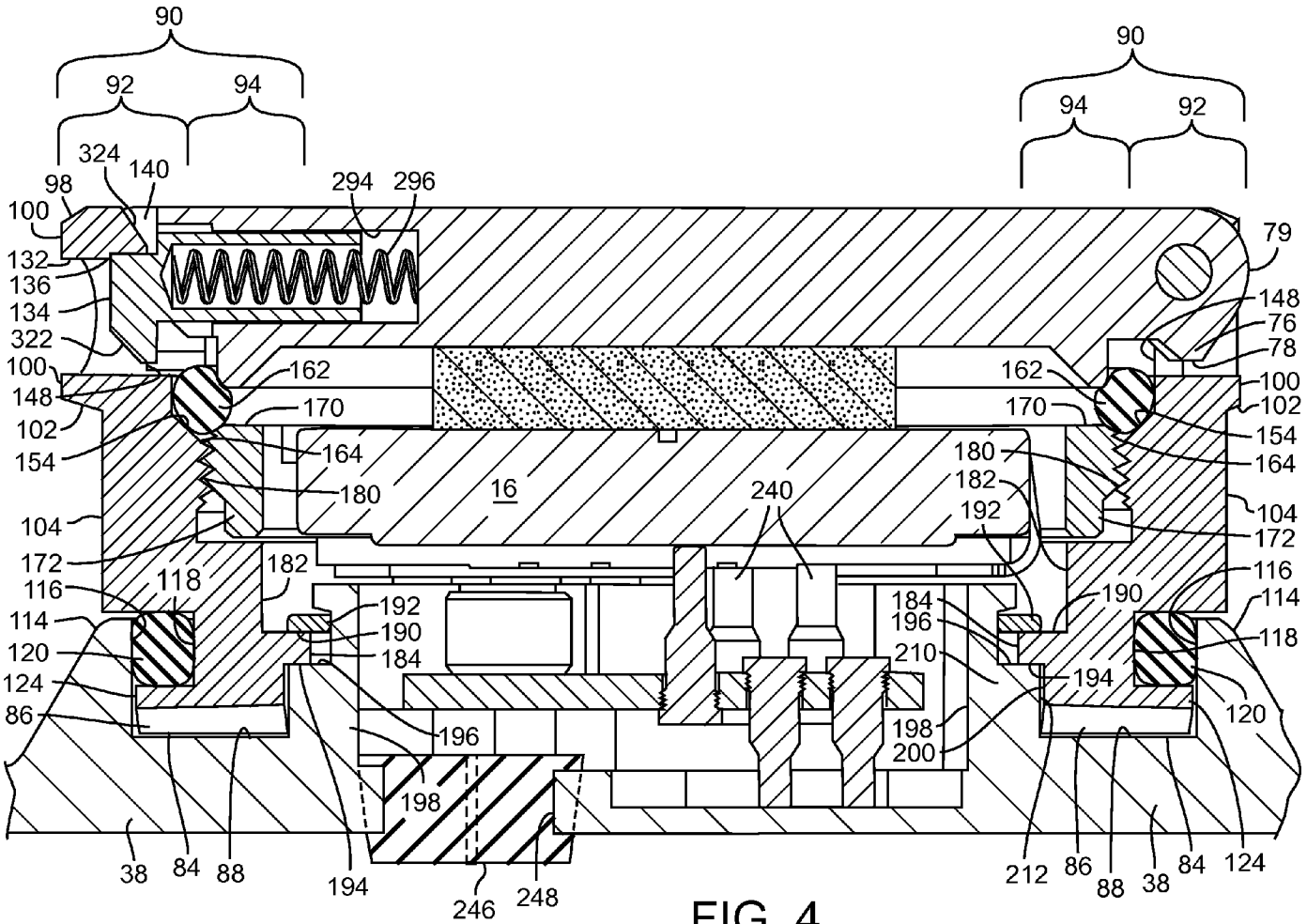

With respect to FIGS. 1 and 4, hinge knuckle 50 includes a tab 76 that spans across notch 54 between first and second inner sidewalls 70 and 72. Tab 76 includes a flat face 78 and a rounded section 79 forming the distal end of hinge knuckle 50. Flat face 78 confronts notch 54 while lid 12 is in the closed position to inhibit debris from entering the internal battery compartment 14 of knob body 30. Rounded section 79 is sized to provide sufficient clearance between knuckle 50 and notch 54 so that knuckle 50 does not bind against notch 54 as lid 12 is moved into the open position.

Figure 2:
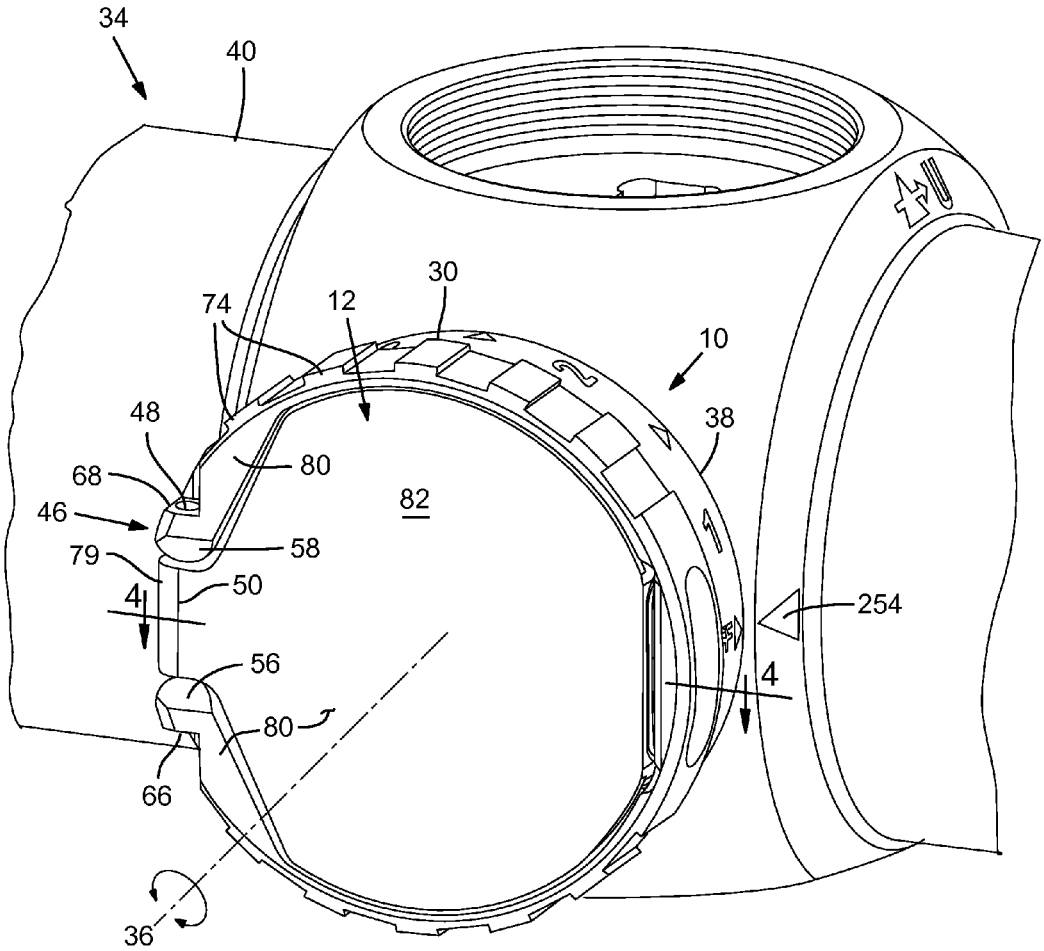
Figure 3:
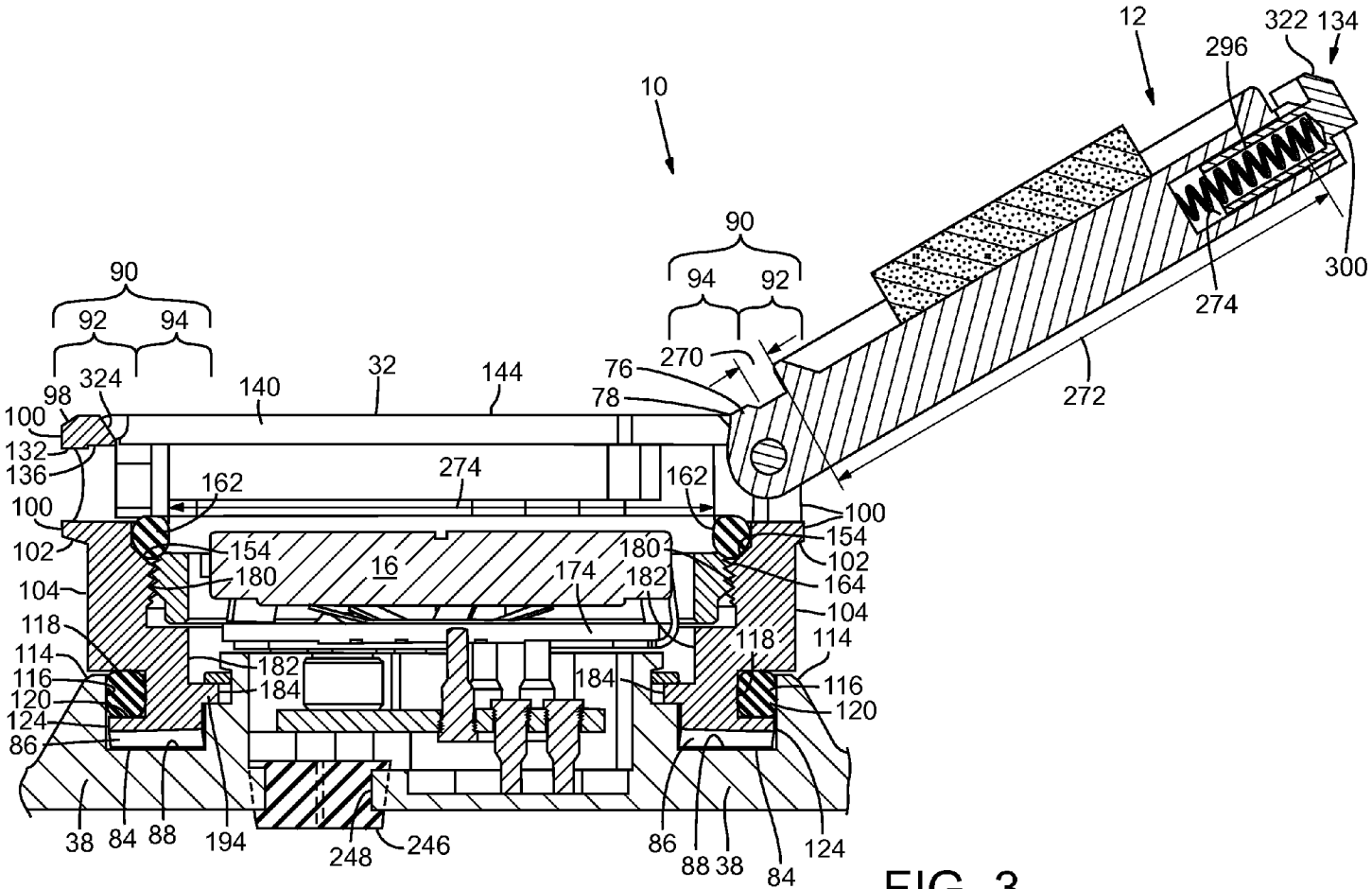
FIGS. 3 and 4 are cross-sectional views of the rotatable adjustment knob of FIGS. 1 and 2, taken along line 3-3 of FIG. 1 and line 4-4 of FIG. 2, respectively.

Knob body 30 includes an outer face 74 that forms a flush exterior top surface 80 with a major outer surface 82 of lid 12 while lid 12 is closed (FIG. 2). Opposite outer face 74, knob body 30 includes a scalloped bottom face 84 with optional detents 86 (FIGS. 5 and 6) for clickable adjustment of knob 10 when knob 10 is mounted in an annular mounting channel 88 (FIG. 5) of seat 38. Between outer face 74 and bottom face 84, knob body 30 includes a stepped-cylindrical profile 90 including an exterior profile 92 and an interior profile 94 (FIGS. 3 and 4).

As shown in FIGS. 3-6, exterior profile 92 defines the following six stepped-sections (or tiers) of knob body 30. First, starting from outer face 74 and ending at bottom face 84, a chamfered lateral corner section 98 is formed along an edge of outer face 74 opposite hinge assembly 46. Second, chamfered corner section 98 widens to a graspable ribbed or knurled turret section 100. Third, a shoulder section 102 gradually necks down in external diameter from section 100. Fourth, section 102 necks down to a graspable neck section 104. Graspable neck section 104 partly overhangs an outer curb 114 of seat 38 that defines an outer sidewall 116 of annular mounting channel 88. Fifth, an annular mounting-seal seat section 118 is circumscribed by a mounting seal 120 that abuts and frictionally slides against outer sidewall 116 of annular channel 88 when knob 10 is rotated. Sixth, an outer channel section 124 confronts outer sidewall 116. As explained in additional detail below with respect to FIG. 6, graspable ribbed turret section 100 also includes an opening 132 for actuating a spring-biased latch mechanism 134 (or simply, latch 134) that engages a latch recess 136 in a portion of knob body 30 opposite hinge assembly 46.

Likewise, interior profile 94 defines seven stepped-sections. First, a recessed portion 140 circumscribes a portion of opening 32 and is shaped to receive a peripheral skirt 142 (FIG. 1) of lid 12. Thus, recessed portion 140 and outer face 74 form an outer ridge 144 encompassing recessed portion 140, which protects lid 12 from side-impact damage while lid 12 is in the closed position. Second, a turret body section 148 (FIG. 4) includes latch recess 136 and two shelf sections 150 and 152 (FIGS. 1 and 6) extending partly around two internally opposing lateral sides of knob body 30. Third, a seal-seating shoulder section 154 (FIG. 6) is slightly recessed in knob body 30. Thus, a lip 158 (FIG. 1) of turret body section 148 overhangs seal-seating shoulder section 154 for seating a resilient seal 162 (e.g., an o-ring) in a seal-seating groove 164 defined by the junction between seal-seating shoulder section 154 and an outer face 170 (FIG. 4) of a ring-shaped locknut 172. Ring-shaped locknut 172 retains a battery-retaining circuit board 174 rotatable with knob 10. Fourth, a threaded section 180 is included for receiving locknut 172. Fifth, a throat section 182 narrows the internal diameter of knob body 30 for concealing various mounting components beneath overlying graspable neck section 104 described previously. Sixth, a retainer flange section 184 has a retainer (bearing) surface 190 facing battery compartment 14 for slidably contacting a snap ring 192, and has a mounting (bearing) surface 194 that slidably contacts and rests atop a seat surface 196 of an annular mounting chair 198. Chair 198 has a base 210 that defines an inner sidewall 212 of channel 88. Seventh, an inner channel section 200 opposes outer channel section 124 of knob body 30. Section 200 confronts base 210 of chair 198.

Figure 5:
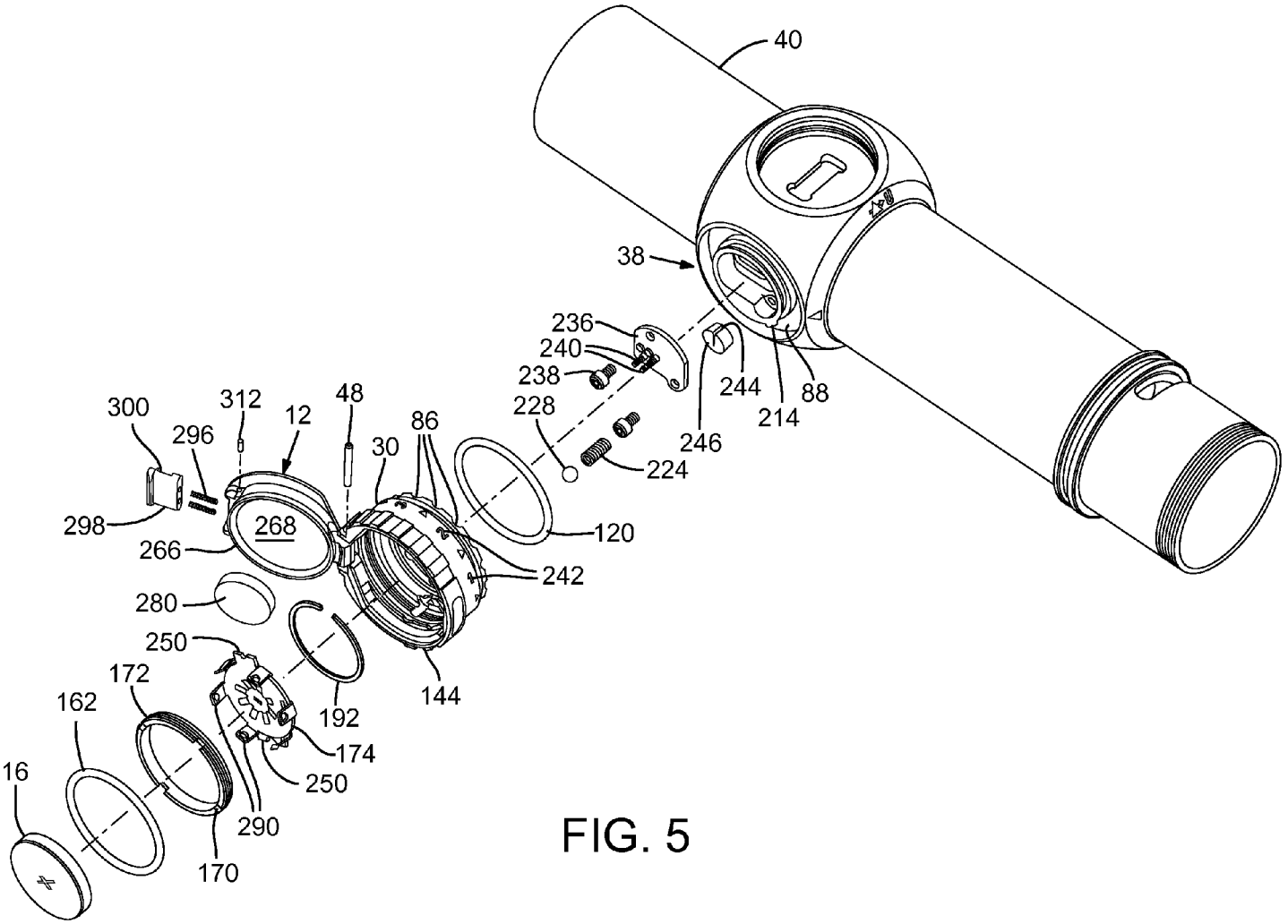
FIGS. 5 and 6 are exploded views of the rotatable adjustment knob of FIGS. 1 and 2.

As shown in FIG. 5, to mount knob 10 to seat 38 (assuming battery 16 and other internal components are removed from knob 10) bottom face 84 is placed into channel 88 such that mounting surface 194 rests on seat surface 196; snap ring 192 is then expanded around a head tab 214 of chair 198 and then released while snap ring 192 is between retainer surface 190 and head tab 214.

A spring 224 is retained upright in alignment with axis 36 in a counterbore (not shown) in channel 88, with a ball 228 placed atop spring 224. Spring 224 remains mounted in seat 38 for applying force against ball 228 to releasably catch detents 86 as knob 10 is rotated about axis 36.

A stationary circuit board 236 is fastened to seat 38 with screws 238. Stationary circuit board 236 includes a pair of telescoping electrical contact pins 240 that engage different pairs of contact pads (not shown) on battery-retaining circuit board 174 as a user rotates knob body 30 and per force board 174. In other words, board 236 and pins 240 remain stationary and thereby contact different pairs of pads (not shown) to complete separate electrical circuits corresponding to settings indicated by selection indicia 242 etched in or painted on neck section 104.

Stationary circuit board 236 provides an electrical signal to an electrical device in riflescope 34 via wires (e.g., flex cable, not shown) threaded through a slot 244 in a split plug 246.

Although the wires (not shown) are threaded through slot 244 from main tube 40, when split plug 246 is inserted into a bore 248 in main tube 40, slot 244 is squeezed together and collapses around the wires. This squeezing force isolates the interior of main tube 40 from battery compartment 14, which may be opened and exposed to the environment.

Battery-retaining circuit board 174 rotates with knob 10 due to PCB tabs 250 extending from battery-retaining circuit board 174 that fit into keyed slots 252 at corresponding locations of interior profile 94 in knob body 30. Thus, as rotatable adjustment knob 10 is rotated about axis 36, ball 228 catches one of detents 86, electrical contact elements 240 align with a set of pads (not shown) to complete an electrical circuit establishing an illumination intensity corresponding to the completed circuit, and a triangular-shaped selection indicator 254 etched in seat 38 is aligned with one selection indicia 242 to indicate the selected illumination intensity.

Lid 12, as shown in the open position in FIGS. 1, 3 and 5, has a seal-seating rib 266 in the form of a raised, annular ridge located on an inner face 268 of lid 12. Seal-seating rib 266 is inset from peripheral skirt 142 of lid 12, and is spaced apart, i.e., offset distance 270, from pivotal axis 64. Rib 266 extends in an axially inward direction when lid 12 is in the closed position. An outside diameter 272 of seal-seating rib 266 is slightly larger than an inside diameter 274 of resilient seal 162 so that while lid 12 is in the closed position, seal-seating rib 266 confronts and presses resilient seal 162 against knob body 30, thereby sealing opening 32 and battery compartment 14 from external elements (e.g., moisture and debris). In some embodiments, seal-seating rib 266 applies sufficient compressive force against resilient seal 162 to form a hermetic seal (i.e., creating an airtight enclosure) in battery compartment 14. In other embodiments, seal-seating rib 266 applies sufficient compressive force such that knob 10 is watertight when submerged in seawater to a depth of 66 feet. In some embodiments, an inside surface 276 of peripheral skirt 142 and recessed portion 140 may be optionally chamfered so that any normal force or increased pressure applied against major outer surface 82, e.g., water pressure, also acts to increase the compressive force applied by seal-seating rib 266 against resilient seal 162, thereby increasing the barrier strength around battery compartment 14.

Resilient seal 162 may be an o-ring of conventional shape suitable for sealing a cylindrical battery compartment, or may be formed in various other shapes suitable for sealing other battery compartments having various shapes, e.g., rectangular. Resilient seal 162 may be constructed of plastic resin, nitrile butadiene rubber, or other polymer materials. According to one embodiment, resilient seal 162 has a cross-sectional diameter in a range from approximately 0.050 inch to approximately 0.090 inch, and a hardness of approximately 50 Shore A. Inner face 268 of lid 12 may also include a resilient foam puck 280 adhered to inner face 268 of lid 12 for assisting in pressing battery 16 against battery contacts 290 of battery-retaining circuit board 174 when lid 12 is closed.

Peripheral skirt 142 is recessed within outer ridge 144 while lid 12 is in the closed position. Therefore, to avoid binding skirt 142 on outer ridge 144 during movement of lid 12 between the open and closed positions, skirt 142 is spaced apart from ridge 144 adjacent notch 54 by a distance sufficient to avoid interference. This distance is dependent on the specific offset and depth of hinge pin 48 relative to the height of outer ridge 144. For example, skirt 142 tapers as it approaches hinge knuckle 50 so that skirt 142 is unimpeded when opened.

Figure 6:
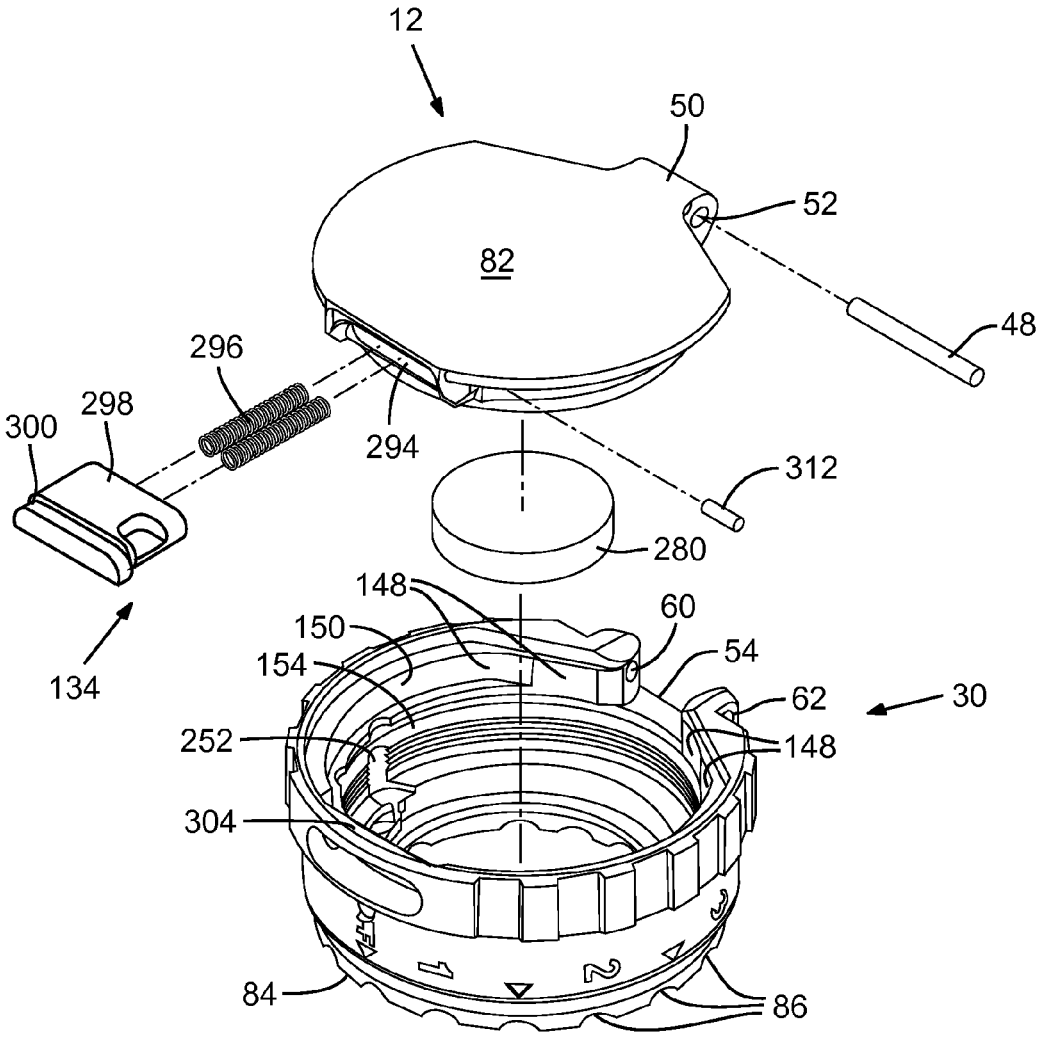

FIG. 6 is an exploded view of knob 10 showing additional details of latch 134. Latch 134 is retractable within a pocket 294 in lid 12 that is under major outer surface 82 but external to resilient seal 162 and seal-seating rib 266. Latch 134 automatically engages latch recess 136 when lid 12 is closed due to springs 296 seated in pocket 294 that force a latch tongue 298 out of pocket 294 to engage latch recess 136 from inside knob 10.

To prevent inadvertent release of latch 134 during manipulation of adjustment knob 10, when lid 12 is closed, a release button 300 of latch tongue 298 is recessed from an outer surface of knob body 30 (e.g., an outer surface of graspable ribbed turret section 100). Therefore, latch tongue 298 is recessed radially inwardly of exterior profile 92 of knob body 30 and is accessible via opening 132 in graspable section 100.

To release latch tongue 298 from latch recess 136 and open lid 12, a tool (not shown) is inserted into opening 132 to depress release button 300, compress springs 296, and retract latch tongue 298 into pocket 294. A long fingernail or any tool smaller than ⅛ inch is suitable for manipulating latch 134, according to one embodiment. The compressive force applied to resilient seal 162 and foam puck 280 when lid 12 is closed acts to lift lid 12 open and out of outer ridge 144 when latch 134 is initially released. When lid 12 is opened, a keeper pin 312 prevents springs 296 from fully ejecting latch tongue 298 from pocket 294.

To facilitate closing of lid 12, release button 300 includes a chamfered face 322. Chamfered face 322 translates a closing force from a chamfered face 324 of outer face 74 into a compressive force that compresses internal springs 296.

In other embodiments, other types of latches may be used to secure a lid in a closed position to a knob body. For example, a magnet may be used as a latch. In some embodiments, a hinge assembly may include a tensioner leaf or spring steel (not shown), or other suitable binding elements may be used to secure a lid in the closed position to a knob body.

Figure 7:
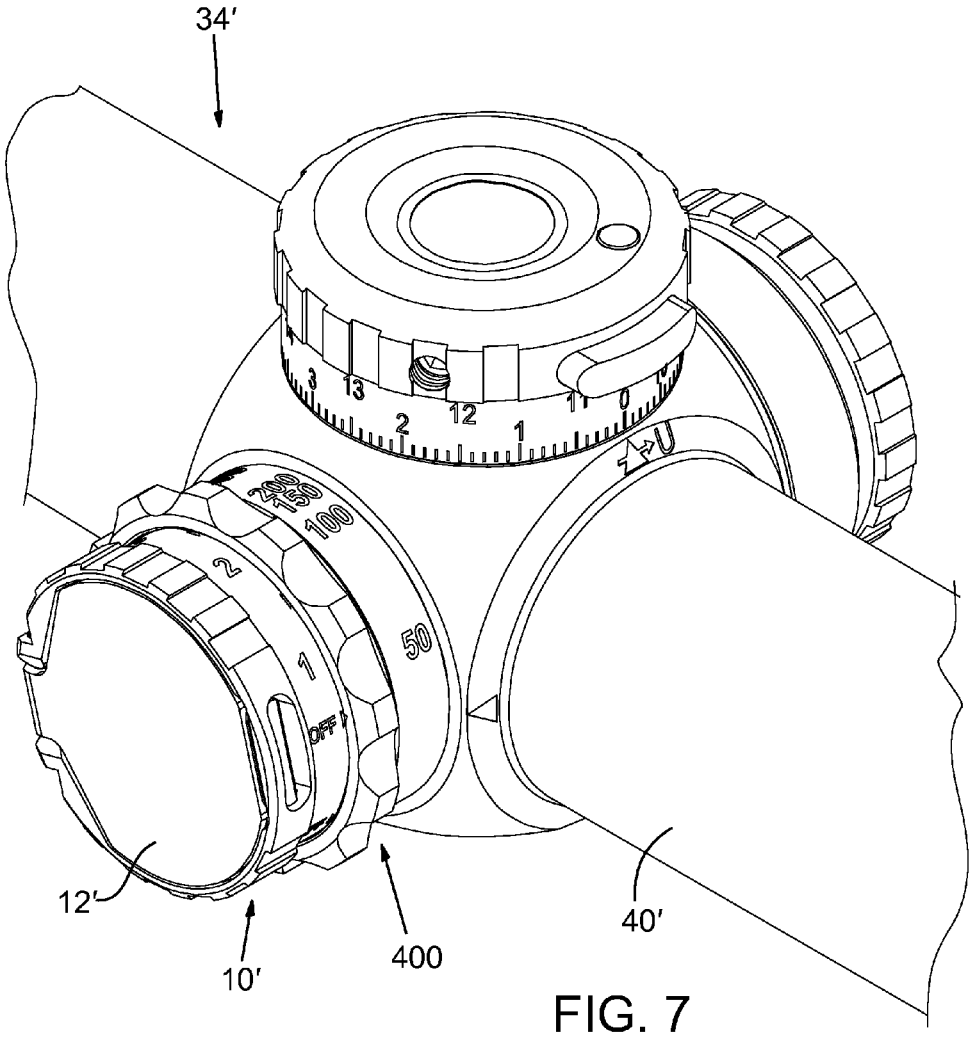
FIG. 7 is an isometric view of a combination hinged-lid rotatable illumination adjustment knob and focus adjustment knob.
Figure 8:
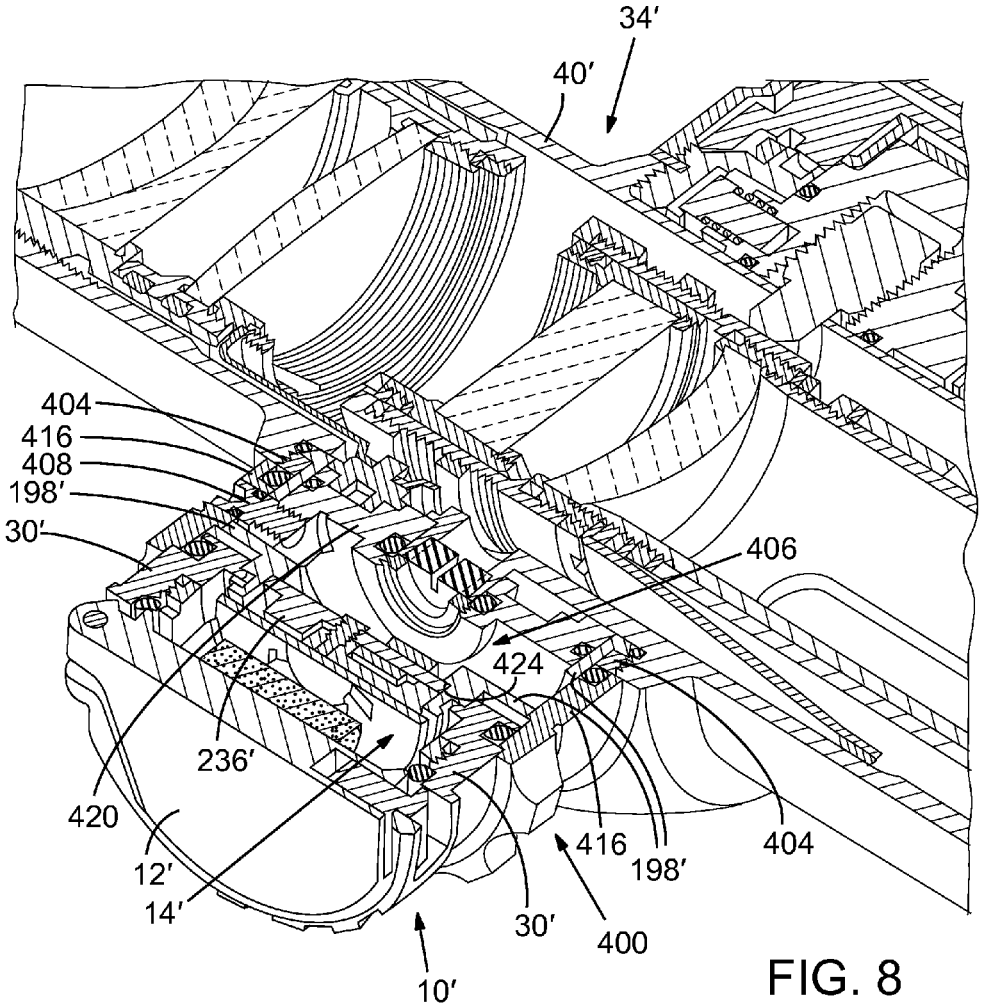
FIG. 8 is a cross-sectional view showing the combination illumination and focus adjustment knob of FIG. 7.

FIGS. 7 and 8 show a riflescope 34' with a hinged-lid adjustment knob 10' nested in a side-focus adjustment knob 400 so that knob 400 circumferentially carries knob 10' in accordance with one embodiment. Component parts and features shown in FIGS. 7-8 that correspond to those of FIGS. 1-6 have the same reference numerals followed by a prime symbol.

Knob 10'differs from knob 10 primarily in that annular mounting chair 198 of the latter is integral to main tube 40, whereas knob 10' includes an annular mounting chair 198' that is fastened to main tube 40' via a lock nut 404. Chair 198' is taller than chair 198 so that a knob body 30' fits partly within and extends beyond side-focus adjustment knob 400; it also includes a slot 406 through which a set screw 408 couples a side-focus knob body 416 to an internal side-focusing cam 420 of the type described in U.S. Pat. No. 6,351,907 or to a different rotatable adjustment mechanism. Thus, cam 420 is encompassed by chair 198' and is rotatable with manipulation of knob 400, independently of knob 10'. Because knob 10' is spaced apart from main tube 40', chair 198' has an annular ridge 424 that supports stationary circuit board 236', and it has a counterbore (not shown) to hold a spring (not shown) as described above for counterbore and spring 224 shown in FIG. 5.

The stacked or piggybacked arrangement of knob 10' provides a lid 12' that swings open without torquing either knob 10' or 400 about their common axis of rotation, which reduces the likelihood of inadvertent side-focus adjustment while accessing a battery compartment 14'. In other embodiments, a piggybacked knob may be stacked within other adjustment knobs, such as, windage, parallax, or other adjustment knob types.

It should be understood by skilled persons that many changes may be made to the details of the above-described embodiments without departing from the underlying principles of the invention. For example, although the present disclosure describes rotatable knobs for use with sighting devices, rotatable knobs may be used to control an adjustable feature of other devices, and may include volume control knobs, channel selection knobs, radio station selection knobs, and other suitable knobs. Therefore, the scope of the present invention should be determined only by the following claims.

The invention claimed is:

1. A rotatable adjustment knob configured to provide a user-selected input to an optical or electronic device having a battery-powered component and an annular mounting channel, the channel defining a seat having a surface at a bottom of the channel and an outer circumferential sidewall bordering the surface, the rotatable adjustment knob comprising:

a knob body mountable to the device for rotation about an axis extending outwardly from the device so that a degree of the rotation corresponds to the user-selected input, the knob body including a bottom face, an upper cylindrical sidewall section, a lower cylindrical sidewall section, and an opening into a battery compartment sized to receive a battery, the knob body, when mounted to the device, having:

the bottom face configured to confront and turn relative to the surface of the seat, the upper cylindrical sidewall section extending away from the channel and sized to be grasped and rotated relative to the outer circumferential sidewall, and the lower cylindrical sidewall section extending within the channel and sized to confront the outer circumferential sidewall;

an electrical contact housed within the battery compartment and providing a battery connection for the battery-powered component;

a lid pivotably attached to the knob body for movement between a closed position in which the lid covers the opening, and an open position in which the lid is pivoted away from the knob body and the opening to facilitate access of the battery compartment, the lid remaining attached to the knob body while in both the open and closed positions for rotation with the knob body about the axis;

a resilient seal bordering the opening and confronting the knob body and the lid while the lid is in the closed position; and a latch to releasably retain the lid in the closed position.

2. The rotatable adjustment knob of claim 1, in which:

the knob body has an outer face bordering the opening, the outer face including a recessed portion extending around at least a portion of the opening;

the lid includes a peripheral skirt that is seated in the recessed portion while the lid is in the closed position, the peripheral skirt extends radially relative to the axis while the lid is in the closed position; and the lid has a major outer surface that is flush with or recessed below the outer face of the knob body while the lid is in the closed position.

3. The rotatable adjustment knob of claim 2, in which:

the knob body includes an outer ridge bordering the recessed portion, and a notch formed in the outer ridge;

the lid includes a hinge knuckle that is positioned in the notch; and the knob further comprises a hinge pin rotatably coupling the hinge knuckle to the knob body.

4. The rotatable adjustment knob of claim 3, in which the lid is pivotably attached to the knob body via a hinge, and in which the peripheral skirt is spaced apart from the hinge a distance sufficient to avoid contact between the peripheral skirt and the knob body during movement of the lid between the open and closed positions.

5. The rotatable adjustment knob of claim 4, further comprising a seal-seating rib located on an inner face of the lid and spaced apart from the hinge knuckle, the seal-seating rib configured to apply compressive force against the resilient seal while the lid is in the closed position.

6. The rotatable adjustment knob of claim 1, in which:

the knob body includes an outer face bordering the opening and a notch formed in the outer face;

the lid includes a hinge knuckle that is positioned in the notch; and the knob further comprises a hinge pin rotatably coupling the hinge knuckle to the knob body to form a hinge.

7. The rotatable adjustment knob of claim 6, further comprising a seal-seating rib located on an inner face of the lid and spaced apart from the hinge, the seal-seating rib configured to apply compressive force against the resilient seal while the lid is in the closed position.

8. The rotatable adjustment knob of claim 6, in which the hinge knuckle includes a tab that confronts the notch when the lid is in the closed position to thereby block debris from entering the battery compartment.

9. The rotatable adjustment knob of claim 1, in which the latch includes a release button recessed from an outer surface of the knob body while the lid is in the closed position, and the release button is depressible to release the latch.

10. The rotatable adjustment knob of claim 1, in which the latch includes:

a latch recess formed in the knob body; and a spring-biased latch tongue that projects from the lid and seats in the latch recess while the lid is in the closed position.

11. The rotatable adjustment knob of claim 1, in which the knob body is manually rotatable about the axis to adjust an illumination intensity setting of a riflescope or other sighting device.

12. The rotatable adjustment knob of claim 1, further comprising a resilient foam puck attached to an inner face of the lid, the foam puck configured to press against the battery while the lid is in the closed position.

13. The rotatable adjustment knob of claim 1, in which the resilient seal comprises an o-ring.

14. The rotatable adjustment knob of claim 13, in which the o-ring has a cross-sectional diameter in a range from approximately 0.050 inch to approximately 0.090 inch.

15. The rotatable adjustment knob of claim 1, in which the opening and the battery compartment are hermetically sealed while the lid is in the closed position.

16. The rotatable adjustment knob of claim 1, in which the knob body is nested in a second adjustment knob mountable to the device for rotation about the axis independently of the knob to adjust a second setting of the device.

17. The rotatable adjustment knob of claim 1, in which the lid is pivotably movable relative to the knob body about a pivotal axis extending in a direction transverse to the axis of rotation of the knob body.

18. The rotatable adjustment knob of claim 1, in which the lid is pivotably movable relative to the knob body about a pivotal axis of the lid that is spaced apart from the axis of rotation of the knob body.

19. A sighting device including the rotatable adjustment knob of claim 1.

* * * * *